US008420923B1

(12) United States Patent
Choi et al.

(10) Patent No.: US 8,420,923 B1
(45) Date of Patent: Apr. 16, 2013

(54) MUSIC PLAYING DEVICE FOR SYMPHONIC COMPOSITIONS

(75) Inventors: Man Wa Choi, Hong Kong (HK); Joseph Battat, Mount Royal, CA (US)

(73) Assignee: Maison Joseph Battat Limited, Montreal (CA)

( * ) Notice: Subject to any disclaimer, the term of this patent is extended or adjusted under 35 U.S.C. 154(b) by 0 days.

(21) Appl. No.: 13/462,113

(22) Filed: May 2, 2012

(51) Int. Cl.
*G10H 1/32* (2006.01)

(52) U.S. Cl.
USPC ..... 84/644; 84/476

(58) Field of Classification Search ..... 84/476, 84/609, 644, 670
See application file for complete search history.

(56) References Cited

U.S. PATENT DOCUMENTS 4,287,568 A * 9/1981 Lester ..... 711/116
5,760,323 A * 6/1998 Romero et al. ..... 84/470 R
6,132,281 A * 10/2000 Klitsner et al. ..... 446/75
6,271,453 B1 * 8/2001 Hacker ..... 84/476
6,353,168 B1 * 3/2002 Sosoka et al. ..... 84/600
6,991,509 B1 * 1/2006 Carley et al. ..... 446/175
7,485,794 B2 * 2/2009 Koizumi ..... 84/601
7,796,190 B2 * 9/2010 Basso et al. ..... 348/445
7,859,409 B2 * 12/2010 Sakurada ..... 340/572.1
2007/0039450 A1 * 2/2007 Ohshima et al. ..... 84/616
2007/0234883 A1 * 10/2007 Koizumi ..... 84/615
2010/0018381 A1 * 1/2010 Ohshima et al. ..... 84/470 R

* cited by examiner

*Primary Examiner* — Jeffrey Donels
(74) *Attorney, Agent, or Firm* — Andrew S. Langsam; Pryor Cashman LLP

(57) ABSTRACT

A music playing device for symphonic compositions allows a user to selective locate one or more musical instrument playing pieces within an orchestral pit and to listen to the series of notes of those instruments placed into the pit. The additive and subtractive benefits of musical instruments are thus appreciated. The device comprises a main base and individual, preferably, three dimensional musical instruments as playing pieces. Multiple symphonic musical compositions are available to be played with only the notes of those instruments being heard if and when placed into the pit area.

31 Claims, 8 Drawing Sheets

MUSIC PLAYING DEVICE FOR SYMPHONIC COMPOSITIONS

FIELD OF THE INVENTION

The present invention relates to a musical toy for adults and sophisticated children (hereinafter collectively referred to as a "user" or "users") which allows them to appreciate the additive and subtractive aural effects of individual musical instruments in connection with one or more symphonic musical compositions. The device allows the user to simultaneously play or recreate the individual tonal sounds of a plurality of individual (preferably up to thirteen but more, too are potentially usable) musical instruments, to aurally appreciate the combination and subtraction of their sounds in one or more musical symphonies. This invention provides an excellent opportunity for adults and adept children (hand dexterity and manipulation of the musical instruments or playing pieces of the device is required) to learn not only the sounds associated with different instruments, but also what instruments look like, and how different instruments sound when combined into harmonies together into a symphonic musical composition.

In the preferred embodiment, as will be described, the device is a toy in that it is meant to be played with, for enjoyment and, yet, while entertaining, it is quite instructive on basic concepts of music. It is a portable device, fully self-contained with multi-channels or tracks of pre-loaded individual sounds of the instruments which make up several symphonies, including, too, speakers and batteries and individual 3-D musical instruments or playing pieces for selective placement into the orchestral pit area for activation of their musical tones. Placement of one or more of the musical instruments into the orchestral pit of the toy causes the musical selection of that musical instrument to be heard and when multiple instruments are placed into the orchestral pits they individually sound according to their contribution to the overall symphony. Similarly, when the musical instruments are removed from the orchestral pit, the tones, notes, etc. associated with that musical instrument, are removed from being heard and no longer form a component of the aurally-heard musical composition.

BACKGROUND OF THE INVENTION AND DISCLOSURE

The present invention relates to a device or toy for adults and hand-adept children which allows the user to combine one or more musical sounds to create a seemingly endless variety of harmonized sounds into an orchestral symphony. The device allows a user to place by finger manipulation the various, preferably three-dimensional musical instruments or pieces (each of which corresponds to a different musical instrument) into an orchestral pit to activate a mechanism which casues the device to play those sounds. Alternatively, the device allows the user to remove one or more of the musical instruments from the orchestral pit and to thereby have the remaining sounds of the instruments within the orchestral pit continue to make their associated musical sounds, collaboratively into a musically pleasing symphonic sound. The decision as to which instruments to play and place in the orchestral pit and to remove therefrom is entirely up to the user. Whether only one instrument is within the pit or several instruments are placed therein, the sounds associated with that musical instrument(s) within the pit aurally merge together into a harmonizing and melodically pleasing musical set of sounds, preferably, one or more of the components of the symphony. Preferably, several multi-channel symphonies are loaded into the device so that the sounds of the instruments can be caused to play their part(s) of one or more symphonies.

The invention comprises a base, configured like a large lima-bean in footprint but intended to represent a concert hall where the three-dimensional musical instruments or pieces surround an absent maestro, virtually but not realistically, standing in the middle. Here, however, in the middle is a recessed orchestral pit area. Once one or more of the three-dimensional musical instruments are placed from the outside perimeter (their "ready to play" location) into the orchestral pit area, the sound associated with that instrument is heard, a part of the overall orchestral symphony. The accompanying additional three-dimensional musical instruments or pieces, which can be selectively placed and thus entered into the orchestral pit to play music (and selectively removed) are initially positioned around the outer perimeter of the base. When a user desires to hear that instrument's' musical contribution to the symphony, he/she removes it from the "ready" position around the base and places that piece into the orchestral pit area. By a mechanical, RFID, magnetic, or other sensing and coupling mechanism or means, placement of the instruments or pieces into the orchestral pit, causes the internal electronics to sense which instrument/piece is within the orchestral pit area and this, in turn, causes the pre-recorded channel or aural track (stored for each instrument for each of the symphonies on an IC) of the overall musical symphony to play, through the speakers. The musical instruments or playing pieces placed within the orchestral pit area can be heard by the user or others. Removal of the instruments/pieces from the orchestral pit disengages that mechanical, RFID, magnetic, or other sensing and playing mechanism and causes the pre-recorded channel of aural sounds for that instrument to cease playing as a part of the overall symphony. Adding and subtracting various of the multiple three-dimensional musical instruments into and out of the orchestral pit area provides a very aurally pleasing device, one that teaches the additive and subtractive values of the instruments of a symphony orchestra and, when the device is provided with several pre-recorded symphonies on an addressable IC, each symphony or musical composition being multi-channel and comprised of several musical instruments, an entertaining device, a teaching device, a toy, etc. is provided.

Preferably, according to the present invention, there are thirteen, three-dimensionally (although two dimensional or flat playing pieces can be used) molded or formed, finger manipulative, individual musical instruments or playing pieces associated with the main base of the present invention. Each instrument is color coded and shaped like one of the instruments in a real symphony. So, for example, there is a Clarinet, a Flute, a Trumpet, a Tuba, a Snare Drum, a set of Cymbals, a Xylophone, a Piano, an Accordion, a Sitar, a Guitar, a Koto, and a Violin. Each playing piece of the present device is preferably three dimensional, finger/hand manipulative (like a chess piece) and a visual representation of one of the musical instruments which add to the musical composition to be played by the device. Each instrument, according to the preferred embodiment, is formed or molded from a different colored plastic or rubber-like material and the small base of each instrument upon which it stands is geometrically unique so that, for example, the drum is red and rests or sits on a small red circular base whereas the piano is formed of blue plastic or rubber and sits on a small rectangular blue base. The main base of the device (to be distinguished from the small bases of the instruments) is provided with rim-colored recesses in shape and size corresponding to the small bases of the instruments so that the instruments are conveniently housed, until placed in the orchestral pit area, in their correspondingly matching shape and color recess. Thus, this aspect of the invention corresponds to a shape "sorter" and color matcher, which is additive to the play and teaching aspects/values of the device. Also, preferably, the name of each instrument is etched into the small base of the instrument pieces to teach the user the name and spelling of each instrument. As mentioned, the small base of each musical instrument/piece is molded into a different geometric shape with each base corresponding to and placeable into a like-shaped recess in the base of the device. There are thirteen musical instruments or playing pieces and each is preferably the same size or slightly larger than a conventional chess piece.

Preferably, the three-dimensional musical instruments or playing pieces comprise a light green clarinet with a square base; a yellow flute with a triangular base; an orange trumpet sitting on a pentagon-shaped base; a light pink tuba on a triangular base where one side of the triangle is outwardly curved, the base thus resembling a pie shape; a red drum on a circular base; light purple set of cymbals on a four-leaf clover (in cross section) base; an aqua-blue xylophone on a five star (in cross section) base; a dark blue piano on a rectangular base; a dark purple accordion on a hexagon base; a hot pink sitar on a cross or plus sign-shaped base; a white guitar on a crescent moon shaped base; a forest green koto on a rhombus-like shaped base, preferably where the sides are curved inwardly; and a brown violin sitting upon an oval-shaped base. The top half of each three dimensional musical instrument or playing piece of the toy-like device is shaped to resemble a corresponding musical instrument which will "play" or elicit the musical notes for aural listening, once that instrument is removed from its recess in the main base of the device and placed into the orchestral pit area.

Preferably, to facilitate learning of the instruments' names and to facilitate an association or learning of the names with the aurally perceived notes, on the base of each piece—the name of the instrument is embossed or otherwise provided. The present invention, therefore, allows an adult or sophisticated child (sophisticated only in that the device requires some measure of fine finger and hand coordination, more than that of an infant, for example) to learn the additive and subtractive benefits of various musical instruments into the symphonic compositions, the basics of certain aspects of music (which instruments comprise the strings, which instruments are brass, which are percussion, which are considered keyboards, etc. and their names, too. In addition, the device teaches or reinforces the learning of spelling of the instruments, sorting and matching colors and shapes, etc. The pieces are large enough (greater than the 1" cylinder choking hazard test) such that a young child will not choke on them and are also lightweight and made of plastic so that they should not break or hurt a child. However, clearly, the ability to carry the main base of the device and manipulate the individual instruments from their small bases to the orchestral pit area and back is not meant for a small tot or young infant.

The base of the device itself is preferably translucent, and this allows the inner components/workings to be observed by a user. Located inside the base are the electronic components and accompaniments for the invention (integrated circuitry with the pre-stored and recorded multiple instrument channels, one for each of the instruments for each symphony) as well as the batteries, speakers, and the other connecting wiring, a wiring harness and a battery casing. The device is intended to operate and be driven by a set of standard, available batteries.

The music played by the present invention is preferably controlled and activated (and shut-off) by a Radio-Frequency Identification ("RFID") mechanism located in the small base of each of the musical instruments which cooperates with one or more RFID readers in the orchestral pit area of the main base of the device. RFID is a technology that uses and transmits radio waves to transfer data from an electronic tag, called an RFID tag or label, attached to an object, through a reader for the purpose of identifying and tracking the location of the object. The tag's information is stored electronically, in this case, within the small base of each of the musical instruments or playing pieces. According to the present invention, the RFID tag (stored inside each three-dimensional musical instrument, preferably within the small base upon which the instrument rests) includes a small RF receiver mechanism and a transmitter. An RFID reader (an antenna placed under the orchestral pit inside the main base of the device) transmits an encoded radio signal to seek and sense placement of an instrument within the orchestral pit area or to interrogate the tag within the small base(s) of the instrument(s) or piece(s) when they are placed within the orchestral pit area. The tag within the musical instrument(s) receives the transmitted interrogation message and responds with its identification information. The tags are passive RFID tags that do not require the use of a battery, but instead use the radio energy transmitted by the reader as its energy source. This allows the power for sensing, activation and playing of the notes of the instrument or playing piece to be contained within the main base, with no battery or power required to be within the individual instruments. This allows for a single replacement of the batteries of the entire device to also serve as replacement of all of the reading and sensing mechanism, including the batteries for the RFID aspects of the device. It also allows for the individual musical playing pieces to be smaller than if they had contained batteries and allows for economy of molding of the playing pieces. The RFID system is relative High-Frequency (HF: 13.56 MHz) yet preferably small range. As each musical piece is individually added into the orchestral pit, the RF reader in the main base will transmit a signal to that piece within the orchestral pit area, the tag will be identified and send its unique identifier back to the RFID mechanism in the main base and will thus serve to identify each piece within the orchestral pit. The main base, with the electronics, the multi-channel stored IC with the digital sounds of the instruments, will be accessed, and the "sounds" transmitted by signals to the speakers for playing that instrument's "part" in the overall symphony composition, i.e., the notes corresponding to the contribution made by the instrument within the orchestral pit area.

The front of the base of the device may also include a series of controls for the user, with a variety of depressible (or otherwise manually manipulable) buttons corresponding to different commands for the orchestral music system. Most prominently, and in the center of the front of the main base—"play" and "stop" buttons control the start and end of a symphonic composition or a song being played, or to change the symphonic or song selection. Preferably located at one side of the center of the on-off (controlling) portion of the main base, there can be provided a set of five buttons which indicate the five categories of available instruments for location of any one or more into the orchestral pit area. So, for example, a button designated for "woodwinds," "brass," "percussion," "keyboards," and "strings" is provided. When one or more of those buttons are depressed, lights will illuminate corresponding in muted color to the applicable three dimensional musical instruments which are within that section of the orchestra ("woodwind" button will illuminate the light in front of and in the same but a muted color to the flute and the clarinet, for example). Thus, this aspect, too, is meant for teaching basics of music to adults and sophisticated children (i.e., not infants). Proximal to the holding recess for each musical instrument/playing piece (atop the perimeter of the main base) can be located a small fluorescent light, each color basically coordinated to the musical sections of the orchestra, woodwind, brass, etc.) for the corresponding musical instrumental or piece. When one of the buttons relating to a musical instrument category is depressed or pushed, the light bulb(s) located in front of those instrument(s) which correspond to that category or section of the orchestra are illuminated.

Specifically, when the "woodwind" button is depressed or pushed, the lights in front of the clarinet and flute are illuminated; when the "brass" button is depressed or pushed, the lights in front of the trumpet and tuba turn on; when the "percussion" button is depressed or pushed, the lights in front of the drum, cymbals, and xylophone activate and are illuminated. Correspondingly, when the "keyboard" button is pushed, it activates the lights in front of the piano and accordion; and when the "strings" button is depressed and pushed, it causes the lights in front of the sitar, guitar, koto, and violin to be illuminated, all in basically the same color as the other member instruments of that section. This provides another learning opportunity for a user, as it teaches not only what each instrument is, but the different sections or categories of instruments of a symphonic orchestra as well.

While a song is playing, a user may press another button to determine which instrument(s) he or she would like to use which will be an accompaniment instrument or a melodic additive instrument. This aspect, too, is controlled by a push button on the main base and the small illuminatable lights in front or adjacent/promixal the recesses for the musical instruments/playing pieces. The control panel for the invention also allows a user to control the song selection, stop in the middle of a song and begin a new one, alter the volume of the song, and even alter the tempo. The control system, and all buttons which connect to the integrated circuitry and wiring containing the multiple digital signal tracks for the songs and the controllers for the lights, buttons, speakers, batteries, etc., are accomplished by suitable wiring, integrated circuits, electronics and RF readers stored inside the main base. The entire system is controlled by an on-off, preferably slide switch located on the front of the main base. It can include an auto-timed off mechanism, to preserve battery life.

In the back of the main base, seemingly underneath the platform for the recesses for the musical instruments (the top surface of the main base being slanted from back to front similar to a stage at a concert hall) there is a holding compartment which can store or house all of the orchestral musical instruments/playing pieces while moving the toy from location to another location. This tends to ensure that no pieces will be accidentally lost.

To use the present invention, a user loads the same with batteries (the device is normally sold with them) and then turns the device "on" by sliding the on-off switch. The user then depresses a "Play" switch or button which cues up a first of fifteen musical compositions. A random generator can be used or the symphonies can be cued in a specific sequence, all according to the manufacturer's choice. Several musical compositions or symphonies are intended to be stored on the integrated circuitry, each being broken down into individual channels of a series of digital notes, one for each of the instruments which are part of the collective instrumental symphonic composition. So, for example, if the musical composition is Twinkle Twinkle Little Star, then one channel of the integrated circuit will store and selectively play the notes of that composition as if emanating from a violin (if the violin is moved from its storage or individual recess position into the collective orchestral pit area). Another stored channel will contain the series of digital notes from the same Twinkle Twinkle Little Star composition but the notes are for another musical instrument, say, for example, the clarinet. When the musical instrument or playing piece resembling the clarinet is removed from its recess and its small base placed into the orchestral pit area, the sound of the clarinet adds to that of the violin, with the two pieces being in timing sync and now both playing their share of the musical composition—Twinkle Twinkle Little Star. If another instrument is then placed into the orchestral pit area, say, for example, the piano, it, too, will commence playing the notes of the song Twinkle Twinkle Little Star and it commences its notes when it is placed into the pit but again in sync with the continued notes of the violin and the clarinet. Those three will then continue to play, like a trio of instruments of the same musical symphonic composition. Preferably, a set of six instruments can be placed into the orchestral pit area (selected from the available preferably thirteen musical instruments or playing pieces) and they will all play the same musical composition but the individual notes will be aurally identifiable, just like a real orchestra. When any one or more of the instruments are removed from the orchestral pit area and their small bases placed back into their storage or holding recesses (although not required), that instrument's notes no longer can be heard and no longer form a component of the musical symphonic composition.

The device is preferably provided with up to 15 musical symphony compositions, each of which is playable by one or more, preferably all 13 but in combinations of 6 at a time, musical instruments. Thus, the digital sound track of notes of each musical composition is recorded and stored on an integrated circuit each with its own channel which is activated by the musical instrument or playing piece being placed into the orchestral pit area.

Once the toy is turned "on" and the "play" button has been pushed, a user may remove the instrument from its recess and place it into the center orchestral pit area, and the notes of the musical instrument corresponding to that piece will play that instrument's notes for the selected symphonic piece or song. If a second piece is added to the orchestral pit, a melody of those two instruments will be played. The same will occur as more pieces are added. A user can create symphonies with any 6 (for that is the preferred capacity of the orchestral pit area) of the total of 13 instruments, for each of 15 musical compositions. Of course the orchestral pit area can be enlarged or decreased in capacity by the manufacturer, just as the available number of pieces to be selected from is a variable. Clearly the variety of played and combined instrumetns for each musical instrument is an intriguing part of the present invention and the device thus leads to a huge or at least quite a bit of non-repetitive "play" value. The orchestral pit is large enough to hold up to six musical instruments or pieces at one time. The user may select any pieces he or she desires (from the available thirteen) for the given melody of musical composition and may use just one piece. If a piece is removed (inconsequential of the order it was previously added to the orchestral pit) the sound and notes of that instrument will be removed from the melody and the music and notes of the remaining instruments in the orchestral pit will continue toplay the symphony. If yet another different instrument is added to the orchestral pit area in the removed-piece's place, that instrument's notes and sound will be added to the aurally perceived musical composition, generally audible to the user and to others. A headphone output can be provided, too, for private use. If a user changes song selection (by depressing the "new song" or "play" button, for example, the new song will begin to play the notes of the combination of instruments then in the orchestral pit area. Again, adding and removing pieces from the orchestral pit will continue playing the musical composition, with the added pieces being in tune and in sync with the timing and tune of the musical composition and the removed musical instruments/pieces being removed from the audible display while the remaining musical instruments and pieces continue to play.

Additionally, and for enhanced aesthetic and possible educational purposes, as pieces are added to the orchestral pit to play the corresponding notes of the corresponding instruments, flashing lights within the orchestral pit area will flicker all across the pit, seemingly in harmony with the music being played, and color-coordinated to match the color of the musical instruments/pieces placed in the orchestral pit area. When more pieces are added to the pit, and more instruments are therefore added to the symphony, those colored lights will shine, too, creating a visually pleasing array of colors in addition to the music.

The present invention, in its current commercial form, is intended to be sold with a total of fifteen songs from which a user can choose one for play at a time. When a song is selected with the "play" button, the device will cue up and activate that song. The selected song will be heard with only that instrument'(s) notes corresponding to that musical instrument or playing piece placed within the orchestral pit area. Controls on the main base, to the left of the center console and opposite the instrument category buttons, will alert the user (by lights associated with the recesses into which the small bases of the instruments are located, before being placed into the orchestral pit) as to which instruments will play melody, and which instruments will play accompaniment, to each instrument, musical composition or song choice. When either the "accompaniment" button or the "melody" button is pressed, the small lights in front of the playing pieces which fit that category for the played musical composition will illuminate. These indications are song specific. A user can then add or subtract any number of those instruments, up to six total into the orchestral pit area (but selected from all 13 instruments available to the user) to recreate the sound with different participating instruments. This allows for a seemingly endless array of musical possibilities, since as many as six instruments taken from 13 available instruments, and as few as one, may be played in the orchestral pit at any one time, i.e., for any one of stored 15 musical compositions. Fifteen musical compositions, any one up to six instruments selected from thirteen total instruments, provides a huge variety of aural possibilities.

In an alternate embodiment of the present invention, the device is provided with a memory card slot or a USB port to allow the device to load and store even more musical compositions and/or to electronically connect to the internet or to another computer. A user can create his or her own musical compositon and individual musical instrument tracks on a computer or download the same from a website of another, with each musical composition having been broken down into multi-channels notes for the instruments of the orchestra.

DESCRIPTION OF PRIOR ART

To the Inventor's and Applicant's knowledge, the only piece of prior art which allows a child to create by adding and subtracting individual musical notes of instruments to "play" a coordinated symphonic-like sound is the Mozart Magic Musical Cube (seemingly associated with U.S. Pat. Nos. 6,366,758 and D433,465) issued to Dunn et al, and owned by Munchkin, Inc.

The Dunn invention is a cube-shaped device with six buttons associated with six different instruments on each of the six sides of the soft-cornered cube. (Col 4, lines 31-44). These buttons, or input devices (as they are referred to by Dunn) each contain a visual graphic which represents a different musical instrument and the buttons are "constructed and arranged to be pushed by an infant or small child." Dunn, as stated, is intended for infants and young children who would simply push buttons on the device until music is heard. It is specifically directed to an infant toy which is child-safe, simple to operate and can be manipulated by small infants. The present invention is similar in musical concept but far more intricate in presentation and use. Also, the present invention uses three-dimensional, removable, placeable, pieces, similar to the shape and look of a variety of instruments and coordinates the audible sound with the physical placement of the three dimensional musical instrument or playing piece into an orchestral pit area. Specifically, Dunn's invention is one "that permits limited improvisation within a controlled number of developmentally appropriate possibilities."

Unlike Dunn, the present invention allows only children with fine hand and fine motor coordination (often referred to herein as "sophisticated") children and adults to remove the small base of the instruments from their recess or holding location and place the same into the orchestral pit area. This seems incapable of being done by an infant, the market to which the Dunn device is specifically directed. A sophisticated child and/or an adult will thus appreciate the opportunity to consciously select various individual musical instruments or pieces (corresponding to three dimensional placement of the same into the orchestral pit or making it a part of the symphony) and determine, on their own, not only the sounds produced by, and associated with each instrument, but also which instruments harmonize together. A child using the present invention should be old enough to understand and have the physical and manual dexterity (fine motor coordination) to move and place three dimensional musical instrument-chess like (in size) pieces into and out of the orchestral pit area. Also, the present invention will reinforce certain musical and other developmental concepts as sorting by shape and color, and the aural and musically pleasing outcome produced by purposefully placing various combinations of musical pieces together in the orchestral pit. One key to the present invention is the use of a different shape of the musical instrument for each playing piece. In contrast, however, the Dunn device is intended to allow activation of any one or more of the presented six musical instruments by the depressing of any one or more of identical and substantial flat buttons, each being a side of a cube. The present invention is intended to coordinate, integrate and thus teach and amuse adults and sophisticated children, by use of three-dimensional physical shapes of musical instruments, and to have the device audibly play the notes in a symphony. The present invention is intended for adults and even sophisticated children (including toddlers if mature and beyond "mouthing" of articles, in contrast to newborns or infants) and to enable the same to learn about different musical instruments, including their shape, look, and the way the instruments names are spelled, in addition to the musical sounds produced by each individually and collectively in a symphony. The additive and subtractive musical effects and qualities of musical instruments in a symphonic musical composition are appreciated, all while "feeling" and seeing the actual three-dimensional, albeit small, shape of the instruments. This is not available by the Dunn device. Additionally, the present invention has added functions, including giving a child or user the opportunity to learn both shapes and colors in addition to music, based on the color- and shape-coordination of the small bases of the individual pieces and the corresponding shapes and colors of the recesses around the main base for use in holding the instruments until placed into the orchestral pit area. Infants using Dunn's invention would not know how to read the wording on each button, and thus would not easily, if at all, associate words with specific sounds.

SUMMARY OF THE INVENTION

It is an object of the present invention to provide a musical device or toy for adults and sophisticated children which entertains and teaches them about the various musical instruments of a symphony orchestra, allowing a user to play composer and conductor and determine which instruments to add to the symphony and which to selectively remove from the orchestra while playing a given musical composition which are capableof being played by many (any six of up to 13, preferably) musical instruments. The present invention teaches users the different sounds produced by each instrument and the way in which they can be combined to form different orchestral melodies. To achieve such object, the present invention comprises a preferably thirteen-piece orchestral set of musical instruments or playing pieces and a main base with an orchestral pit (preferably recessed from the top surface of the main base) in the center. Located around the perimeter of the orchestral pit will be a set of colored and uniquely shaped recesses, within which will sit, in their "ready" mode, not playing, the musical instruments or play pieces until placed in the orchestral pit area. Each musical instrument is preferably three dimensional and preferably finger/hand manipulable to remove the same from the corresponding recess for placement within and removal from the orchestral pit area (and upon removal, re-securement back into the recess). Each musical instrument or playing piece is intended to physically resemble a different musical instrument of a symphonic orchestra. Each piece is preferably formed or molded from a rubber or plastic material. Each musical instrument or playing piece is preferably a different color. According to the preferred embodiment, the array of pieces includes: a clarinet, a flute, a trumpet, a tuba, a snare drum, a set of cymbals, a xylophone, a piano, an accordion, a sitar, a guitar, a koto, and a violin. Each piece preferably has the name of the instrument etched into its small base, and the base of each piece is a different geometric shape which corresponds to a like-shaped recess in the top of the main base of the device. This helps foster shape and color matching and placement of the playing pieces back into their corresponding locations/recesses when removed from the orchestral pit area. The small base of the musical instruments will thus only fit within the correspondingly-shaped and sized recess for that instrument in the main base. This ensures that, for example, the violin is always located adjacent to the koto, the snare drum next to the tuba and the set of cymbals, the woodwind instruments (flute and clarinet) on the main base but opposed to the violin, etc. at least until the instruments are selectively placed into the orchestral pit.

Recognition of the instrument placed into the orchestral pit area is accomplished by use of Radio-Frequency Identification ("RFID") technology in the main base of the device and individual RFID tags located within the small bases of each of the instruments. Thus, when the piano, for example, is placed into the orchestral pit area, the main base senses that the piano musical instrument or playing piece is there, not one of the musical instruments still with their small bases within the correspondingly shaped recesses around the orchestral pit area, and the device then plays (for audible listening and enjoyment) the notes of the piano for that particular symphonic composition. Correspondingly, the RFID sensing and activation mechanism does not "read" nor identify the musical instruments when placed within their recesses in the main base as the "interrogation" and reading of the RFID tag is limited to the area within the orchestral pit area. An RFID tag, which includes a small RF receiver and transmitter, is stored inside the small base of each musical instrument or playing piece. By locating the tag within the musical instrument, no batteries are required for each of the instruments. Thus, batteries are only contained within the main base (where space is not as much of a premium as the small musical instruments) for driving all electronics including the RFID interrogation and sensing mechanism. The RFID tags within the individual musical pieces generate the notes for that musical instrument or playing piece only when the instrument is selectively located within the orchestral pit area. An RFID signal transmitter and reader, connected to batteries within the main base, transmits an encoded radio frequency signal from the main base to the tag in any of the musical pieces to "interrogate" the tag, as and when it is placed into the orchestral pit area of the main base. The tag is housed within the individual musical instruments or playing pieces and will receive the encoded message from the transmitter and respond with its unique identification information. This will identify to the RFID reading electronics within the main base which of the musical instruments or playing pieces are physically within the orchestral pit area. The RFID tags are passive RFID tags that do not use a battery, but instead use the radio energy transmitted by the transmitter/reader located in the main base as its energy source. As each musical instrument/playing piece is added to (or selectively removed from) the orchestral pit area, the RF transmitter and reader in the main base identifies each piece within the orchestral pit area (by the unique identification tag embedded within the musical instrument/playing piece) and the associated digital musical track or notes (stored on integrated circuitry in multi-channel form) for that particular instrument for that symphonic composition will be audibly presented in time synchronism with the other instruments already playing the same symphonic composition (when within the orchestral pit area). A coordinated, in time sync, set of notes and sounds will thus play an integrated symphonic musical composition. Only those musical instruments/playing pieces physically within the orchestral pit area will play and be heard. A totally intriguing, educational, fun, audibly exciting experience is provided. As more pieces are added to the orchestral pit, a symphonic melody is created with the combination of instruments included, identifying to the user using the device the sounds created by each individual instrument as well as the sounds of the instruments in harmony and in time sync for that symphony. Preferably several musical compositions are available, too. The present invention allows for a seemingly infinite number of combinations of the aural sounds of individual musical instruments, giving the user the opportunity to learn and appreciate the additive and subtractive effects of individual instruments into a melodic symphonic musical composition.

DETAILED DESCRIPTION OF THE DRAWINGS AND THE PREFERRED EMBODIMENT

Description will now be given of the currently preferred embodiment of the invention with reference to the attached FIGS. 1-8. It should be understood that these figures are exemplary in nature and in no way serve to limit the scope of the invention as the invention will be defined by claims, and the scope of the invention will be the scope of the claims, as interpreted by the Courts.

Figure 1:
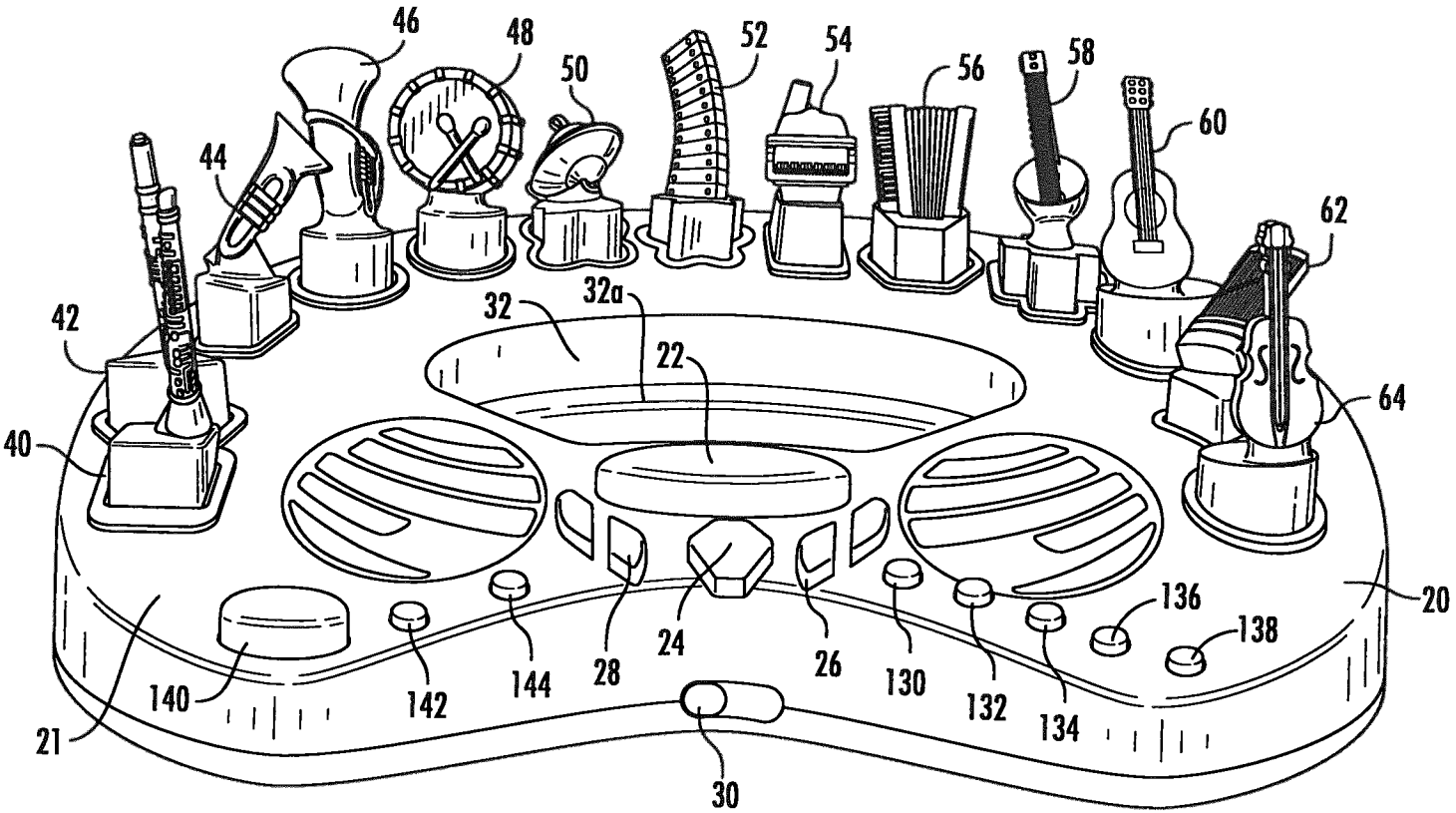
FIG. 1 is a front perspective view of the present invention.
Figure 2:
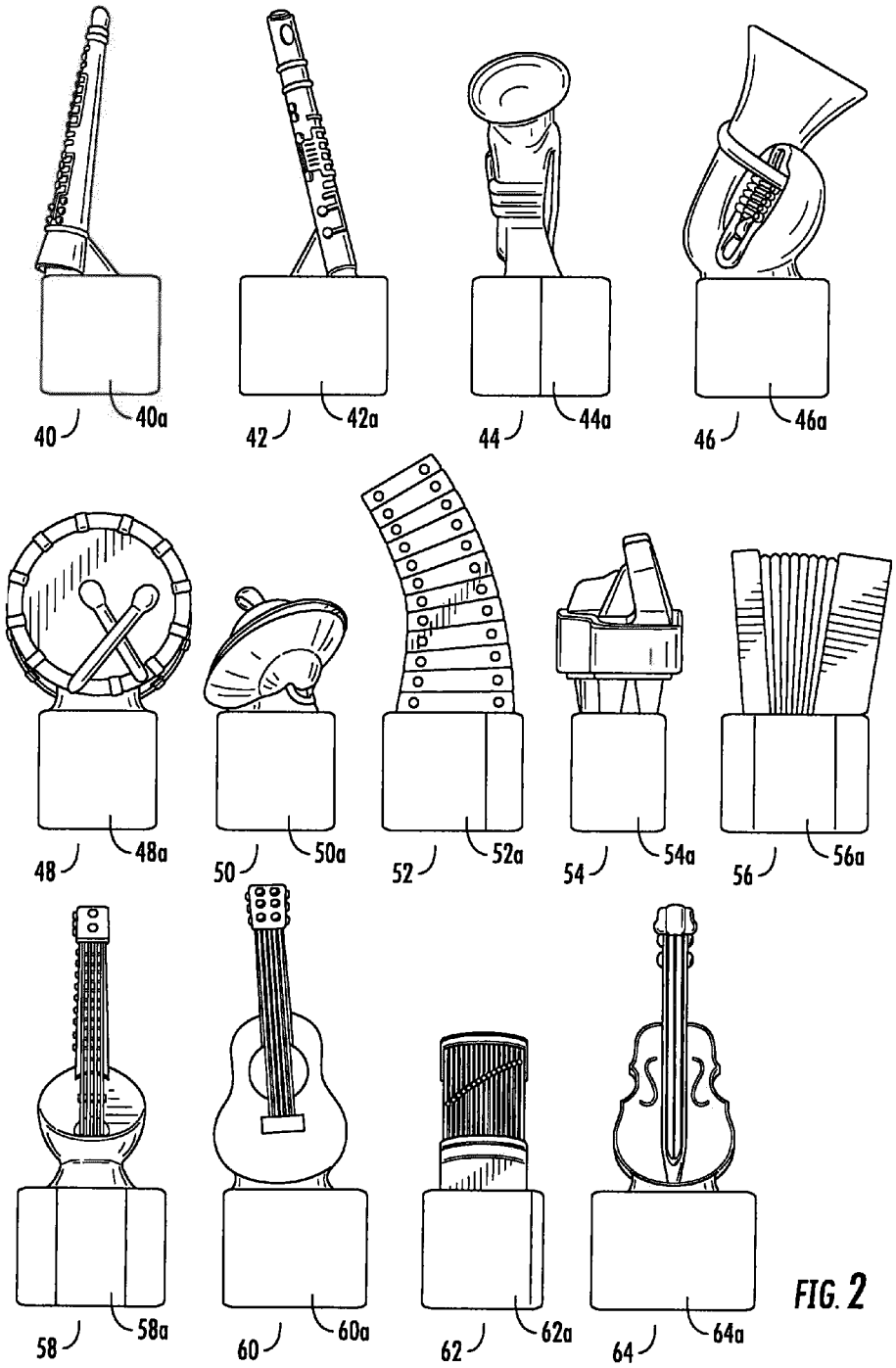
FIG. 2 is a front perspective view of the thirteen individual musical instruments for use with the main base of the present invention. These are also referred to as the playing pieces.

FIG. 1 is a front perspective view of the present invention. As is shown, the invention is made up of main base 20, as well as thirteen individual musical instruments or playing pieces 40, 42, 44, 46, 48, 50, 52, 54, 56, 58, 60, 62, and 64. The main base is a basic three dimensional lima bean-like shape with a slightly tilted (higher back than the front) top surface 21, i.e., slanted forwardly and downwardly, back to front, with respect to the flat bottom 70 (see FIG. 7). FIG. 2 is a front perspective view of the thirteen individual musical instruments or playing pieces 40-64, shown separated from main base 20. The individual playing pieces each have a small base. Each small base of the individual musical instruments is preferably uniquely shaped. So, for example, small base 40*a* (see FIG. 2) for the clarinet shaped, three-dimensional musical instrument or playing piece 40, is a square in cross section. The small base 42*a* for the flute-shaped musical instrument or playing piece 42 is a triangle in cross section. Each musical instrument or playing piece is preferably a different color, too. So, for example, the trumpet musical instrument or playing piece 44 sits on a small base 44*a* which is an orange pentagon in cross section while the tuba-representing musical instrument or playing piece 46 sits on a rose colored small pie segment in cross section base 46*a*.

The main base 20 is provided with a set of recesses, preferably located around the rear section and close to the edge of the top surface 21. Each recess corresponds in shape to the small base of the instrument which can be contained in the recess. So, for example, referring to FIGS. 1, 2, and 3, recess 100 is a square in cross section (lime green) which is shaped and sized to accept small base 40*a*, also shaped as a square in cross section, of the clarinet 40 (also in lime green). Similarly, recess 108 is a red-rimmed circular in cross section recess in the top surface 21 of the main base 20 and it is thus shaped and sized to hold the small circle in cross section base 48*a* of the snare drum 48, a musical instrument/playing piece formed or molded in corresponding red.

Recesses 100 through 124 are colored or rimmed with color and shaped and sized to hold the small bases 40*a* through 64*a*, respectively, of musical instruments 40 through 64, respectively. The cross section of the recesses 100 through 124 are shaped and color coordinated to the shape and size of the cross sections of the small bases of the musical instruments/playing pieces. So, the small bases, 40*a*, 42*a*, 44*a*, 46*a*, 48*a*, 50*a*, 52*a*, 54*a*, 56*a*, 58*a*, 60*a*, 62*a*, and 64*a*, respectively, of the musical instruments 40, 42, 44, 46, 48, 50, 52, 54, 56, 58 and 60, respectively, fit within the recesses 100, 102, 104, 106, 108, 110, 112, 114, 116, 118, 120, 122, and 124, respectively, on the top surface 21 of the main base 20. The musical instruments or playing pieces are stored and held in their respective recesses until physically removed and placed (by careful manual manipulation and fine hand and fine motor dexterity) by the user into the orchestral pit area 32.

The musical instruments or playing pieces are formed or molded of a smooth, tactile-suitable rubber or plastic and are preferably a three dimensional replication of many of the musical instruments of a symphonic orchestra. So, musical instrument 52 is a set of cymbals (in maroon), piece 52 is a blue xylophone, piece 54 is a deep blue piano, piece 56 is a purple accordion, piece 58 a pink sitar, piece 60 is an egg-shell white guitar, piece 62 is a green koto and piece 64 a dark brown violin. Preferably, the small bases 40*a* through 64*a* of each musical instrument or playing piece 40-64, respectively, are provided with the name of the instrument embossed, printed, or molded into it. This, too, adds to the cumulative teaching of musical appreciation and understanding. Each small base is preferably colored to match the musical instrument it supports and each base is unique in shape so that, preferably, each small base will only fit within a single recess in the main base. The colors of the small bases match the color of the recesses (or the rim of the recesses) into which the musical instruments or pieces are placed, when not within the orchestra pit area 32.

In the center of base 20 is the orchestra pit area 32, where the individual musical instruments or playing pieces 40-64 are selectively placed to play their musical notes of the symphonic composition. The present invention provides thirteen different musical instruments or playing pieces 40 through 64, each corresponding to the instrument for which it is shaped (and the musical notes which will be played by the device when the instrument(s) are placed into the orchestral pit area 32). As stated, these musical instruments or playing pieces include a clarinet 40, a flute 42, a trumpet 44, a tuba 46, a snare drum 48, a set of cymbals 50, a xylophone 52, a piano 54, an accordion 56, a sitar 58, a guitar 60, a koto 62, and a violin 64. Preferably, the orchestral pit area is comprised of two floor areas 32*a* and 32*b*, which, in the preferred embodiment, allow for the small bases of any four instruments to be placed onto floor area 32*a* and the small bases of any other two instruments to be simultaneously placed onto floor area 32*b*. Floor area 32*a* is recessed below the top surface 21 of the main base and floor area 32*b* is further recessed below floor area 32*a* and also recessed below (further below) the top surface 21 of the main base. This easily allows the various instruments to be visible to a user without one instrument in the orchestral pit area 32 blocking the view of another instrument in the same orchestral pit area. This can be important especially since, as can be seen in FIGS. 1 and 2, the various musical instruments or playing pieces are not necessarily the same overall height nor are they molded or formed to scale.

To use the present invention, a user can remove any small base 40*a* through 64*a* of the musical pieces 40-64, respectively, from their respective recesses, 100 through 124, and place the same into the center orchestral pit 32, onto floor area 32*a* or 32*b*, located in the center of the base 20. Once the device is turned on (by sliding a switch 30 to the "on" position, from the "off" position) and the play button 22 is depressed, the notes associated with that musical instrument placed into the center orchestral pit area 32 will start to play. As more pieces are placed into and removed from the orchestral pit area, those pieces will start to play their notes in timing syncrony with the other instruments already in the orchestral pit area or the instruments will no longer be heard, when the instrument(s) is removed. All instruments within the orchestral pit area will be playing the same musical composition, forming a symphony, and all notes generated by each musical instrument will be in time with the other notes, just like a symphony ought to sound.

The notes and music generated by the device comprise various musical symphony compositions, substantially all of which are "recorded" on the internal electronics as one of many multi-tracks (a track for each instrument for each musical composition) for selective playback. So, for example, if the musical composition is Brahm's Lullaby and the piano 54 is placed into the orchestral pit 32, the notes of that musical composition will be heard as played only by the piano. If, then, a violin 64 is placed into the orchestral pit 32, after say 20 seconds of listening to the piano, the violin will initiate its notes of the same musical composition, Brahm's Lullaby, with its notes melodically merging into those continued on by the "still in the pit" piano. That is, the notes of the now-placed violin 64 will be in beat and time-synch with the notes of the piano 54 so that the two instruments are simultaneously contributing to the overall musical symphony composition, Brahm's Lullaby. If, then, in addition, a flute 40 is added (say 10 seconds later) into the orchestral pit area 32, then its notes, too, will merge into the symphonic musical composition, again in time synch, with the other two musical instruments still in the orchestral pit area—the piano 54 and the violin 64. Then, say, the clarinet 42 is added into and the piano 54 removed from the orchestral pit area 32, the user will hear the musical composition, Brahm's Lullaby, as played by the violin 64, the flute 40 and the clarinet 42 (but not the piano 54) all notes being melodically in time synch with one another. Up to six musical instruments (in the preferred embodiment) can contribute to the musical composition as and when they are placed into the orchestral pit area 32 (onto floors 32*a* and 32*b*), with the six instruments being selected from the overall thirteen (in the preferred embodiment) available instruments 40 through 64. Thus, for each musical composition playable by the present invention, there will be up to 13 musical tracks recorded, one for each potential instrument to be played, when the instrument is placed into the orchestral pit. And, for each musical composition, up to six instruments' audible notes and sounds can be heard when the selected six (or fewer) of the total 13 instruments are placed into the orchestral pit.

The number of combinations, then, for each musical composition is believed to be Equation 1: 13!/((13−6)!6!) (where ! is read "factorial") if six instruments are always played. Or, stated differently, it is believed that the total number of instrument combinations, where order doesn't count (as there is no difference between a composition with, for example, a sitar and a flute OR a flute and a sitar) is, for 13 available instruments, taken as one, two, three, four, five, or six instruments playing in the orchestral pit area 32, is in the order of over 4,000. It is believed that the number of instrument combinations if all six, in the example, instruments are needed for play from the set, is set forth by the mathematical equation:

# of instruments available (or 13 in the example) factorizalized divided by ((number of instruments available (13) less the number of instruments capable of being played at any one time (6)) factorial times (and still in the denominator) the number of instruments capable of being played at any one time (6), also factorialized. For the 13 instruments, then, with 6 being necessarily placed into the orchestral pit area, is set forth by the equation 1 above. However, according to the present invention, fewer than the maximum will also play the musical composition, so that one, two, three, four, and five instruments, too, can play their individual musical channels in a melodic symphonic orchestral sound for each musical symphonic compositon. It is believed that the number of different musical combinations (where even 1 instrument playing a solo is considered a "combination") is 13!/((13−6)!×6!) plus 13!((13−5)!×5!) plus 13!((13−4)!×4!) plus . . . 13!((13−1)!×1!). This is believed to be "over 4000" combinations, for each musical symphonic composition. When the device is loaded with 15 or more separate musical symphonies, the 13 instruments (stored as 13 sound tracks or channels for each of the symphonic compositions) playable in combinations of solos, duets, etc. up to six in the orchestral pit area 32, provides over 60,000 combinations of audible tones coordinated into musical symphonic compositions, much to the delight, amusement and learning experience of the user.

If a second musical instrument or playing piece is added to the orchestral pit 32, a melody of those two instruments is played. The same will occur as more pieces are added. The orchestral pit 32 is large enough to hold up to six pieces at one time. The user may select any pieces he or she desires for the given melody, and may use just one piece, or any number up to six total. If a piece is removed (inconsequential of the order it was previously added to the orchestral pit) the sound of that instrument will be removed from the melody and from being a part of the audible musical composition, and the music will carry on with the remaining instruments in the orchestral pit 32. If a new instrument is added in that removed-piece's place, that instrument's sound will be added to the symphony of instruments being audibly heard by the user and others, and thus a symphonic musical compostion is provided.

The controls for the present invention are all located in the front section of the top of base 20, in front of the orchestra pit area 32. To begin using the present invention, a user must switch the slidable "on-off" button 30. Then he can initiate a first musical composition or song by depressing the "start" button 22, and at any time can stop the song by depressing the "stop" button 24. The "on-off" slide button can be used, too, to turn the device on or off, as desired. A user may also hit the "play" button 22 a second time, with the device "on" to change musical compositions or songs. Once a user has hit the "play" button 22, he or she can add any musical instrument or playing piece 40 through 64, into the orchestra pit area 32 (holding up to 6 instruments) and the device will recognize that given piece as being "active" and thus the RFID electronics are caused to sense, identify and select the instruments' associated musical track for that musical composition and to begin to play the notes for the instrument for the song selected. The music played by main base 20 is controlled by the Radio-Frequency Identification ("RFID") technology in the device which transmits a signal which is received by the RFID tag embedded into the small bases 40*a* through 64*a* of the instruments in the orchestral pit area and those instruments then transmit the unique instrument identifier back to the integrated circuitry storing and thus playing the individual sound tracks for the instruments, for that musical composition. RFID is a technology that uses radio waves to transfer data from a unique electronic tag, called an RFID tag or label, attached to an object (in this case embedded within the small bases 40*a* through 64*a* of the instruments) through a reader in the main base, for the purpose of identifying and tracking the object (the instrument). The tag's unique information, stored electronically inside of each instrument, includes a small RF receiver and transmitter. The RFID tag is embedded into the rubber or plastic of the musical instruments and, yet, the thickness of the bottom of the rubber/plastic layer of the small base is such that it will not block the receipt and transmission of the signal from the tag to the electronics, when the instrument(s) are located within the orchestral pit area 32. The antenna for the RFID receiver in the main base is located or "tuned" or focused to only "read" those instruments which are within or immediately adjacent or the orchestral pit and, significantly, will not "read" nor transmit a false indication of an instrument being in the orchestral pit area IF the instrument is actually not therein or if the instrument(s) is(are) within their respective housing and storage recesses. As an alternate embodiment, the range of the receiver in the orchestral pit area is small and/or the individual recesses for the small bases of the instruments are lined such that the RFID tag within the small bases are not capable of being "read" by the receiver in the main base when the small base(s) of the instrument(s) are within their recesses.

An RFID reader or receiving antenna is placed under the orchestral pit 32 inside the main base 20, and initially transmits an encoded radio signal to interrogate the tag within the instrument, when placed into the pit 32. The tag receives the message and responds with its unique identification information. Then, the reader in main base 20 will cause the stream of notes (channeled in the integrated circuit for that musical composition) and that specific instrument within the orchestral pit area 32 which corresponds to the responding tag or the instrument. For example, if clarinet 40 is placed into the orchestral pit 32, the reader in base 20 will recognize the unique tag in clarinet 40, and the selected song will be played by only the digital notes of the clarinet. Any song may be played initially, and solely, by any of the thirteen instruments. Each instrument, its corresponding piece having been placed in the orchestral pit to play a song, has the ability to harmonize with the various other and different instruments, allowing for a vast array of musical combinations for each musical symphony and, when many symphonies are provided a huge variety of combinations is provided.

Once a user has started a song and placed at least one musical instrument or playing piece 40 through 64 (but no more than six) into the orchestra pit area 32, the melody button 144 and accompaniment button 142 can be activated. These will alert the user, when selectively depressed, as to which other instruments could play in melody and/or in accompaniment with the given instrument chosen and already selected into the orchestral pit area 32. This is coordinated by the electronics, wiring and integrated circuitry. To do so, a small light will illuminate in front of each piece for which the "melody instrument(s)" or "accompaniment instrument(s)" applies. For instance, if clarinet 40 was placed into orchestral pit 32, and the "melody instrument(s)" button 144 was pressed, the light 154 in front of trumpet 44, the light 162 in front of xylophone 52, light 164 in front of piano 54, and light 174 in front of violin 64 will likely illuminate for a particular musical composition or symphony. A user will know that those instruments, up to a maximum of six in number, can then be added (one at a time, or in combinations up to five total) to the clarinet in the orchestral pit area, and those instruments will likely play in melodic harmony with the clarinet. Also, the volume of the musical composition or song being played may be changed by depressing the "up volume" or "down volume" button(s) 26, also on the top of the main base. The tempo or speed of the musical composition or the song may be adjusted, too, by selective depressing of the "increase tempo" or "decrease tempo" button(s) 28. This, too, is controlled by the internal circuitry, in a well known manner. The "on-off" button can be connected to a time-out circuit such that the device will automatically turn off if a button or instrument is not moved within a predetermined time or after the completion of the musical composition. This auto-off feature will save battery life of the device.

Similarly, if a user wants to learn the different categories of instruments, he/she may push any of the category buttons 130-138 located along the front edge of the main base 20. If the "woodwind" button 130 is depressed or pushed, the lights 150 and 152 in front of clarinet 40 and flute 42 will illuminate; if the "brass" button 132 is depressed or pushed, the lights 154 and 156 in front of trumpet 44 and tuba 46 will illuminate; while if the "percussion" button 134 is depressed or pushed, the lights 158, 160, and 162 in front of snare drum 48, set of cymbals 50, and xylophone 52 will illuminate. If the "keyboards" button 136 is depressed or pushed, the lights 164 and 166 in front of piano 54 and accordion 56 will illuminate; and if the "strings" button 138 is depressed or pushed, the lights 168, 170, 172, and 174 in front of sitar 58, guitar 60, koto 62, and violin 64 will illuminate. These lights are all powered by the contained batteries within the main base and illumination is provided by suitable and quite conventional internal wiring. The individual lights in front of each piece can be best seen in FIG. 3, which is a top perspective of the present invention with the individual musical instruments or playing pieces 40-64 having been removed. The control system, and all depressible and/or activation buttons which connect to the internal wiring, the lights, the integrated circuits, the speakers, the wiring harness, etc. are held securely therein. All are controlled by appropriate and quite conventional electronics. The RF reader and its associated electronics are also stored inside the main base. Only the RFID tags are located within the individual instruments.

As pieces are added to the orchestral pit 32 to play the corresponding notes of the musical instruments for a particular musical symphonic composition, flashing lights (randomly located) in the orchestral pit 32 will also be caused to flicker across the pit, seemingly in harmony with the music being played, and in color coordination to match the color of the pieces placed into the pit. Therefore, if piano 54 is placed into orchestral pit area 32, dark blue lights (the piano is dark blue) would be caused to flash in the orchestral pit area 32 during the playing of the notes of the piano's "part" of the musical composition or song. When more instruments or playing pieces are added to the orchestral pit, and more instruments are therefore added to the symphony being aurally perceived, those coordinated-to-the-instrument(s) colored lights of the pit area will illuminate as well, creating a visually pleasing array of flashing colors in addition to the harmonic and melodic music. Accordingly, if guitar 60 was then added to the orchestral pit 32, of course, the notes associated with the guitar for that musical composition would be heard and be in timing synchrony with the piano, still playing, but, in addition, white lights would flash in the pit 32 in addition to the dark blue ones (for the piano). As a musical instrument or playing piece is removed from the orchestral pit, so too its corresponding colored flashing lights in the orchestra pit area will cease being illuminated (and, of course, its notes will cease as well).

Figure 3:
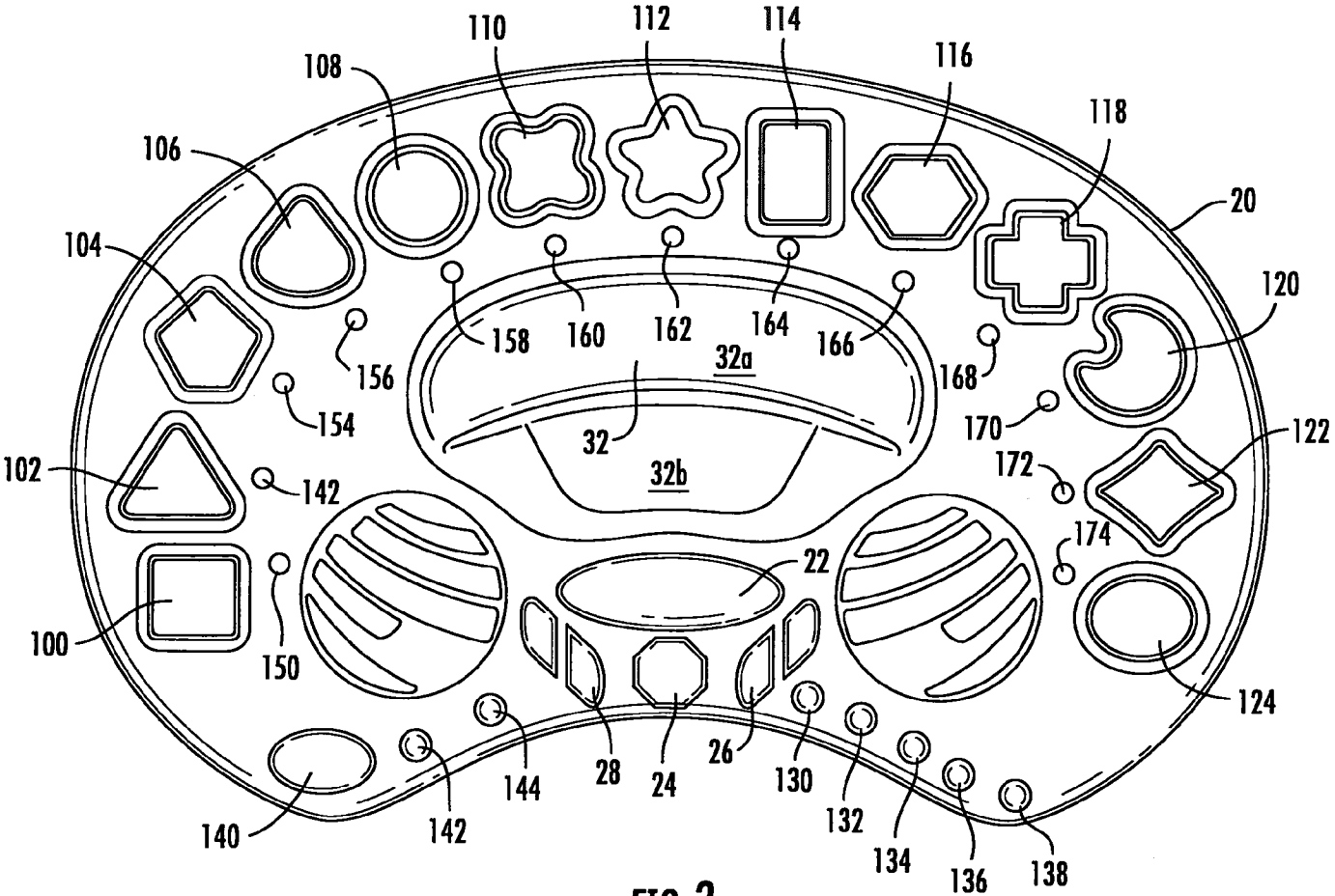
FIG. 3 is top view of the main base of the present invention with the individual musical instruments or playing pieces having been removed for ease of understanding.

As can also be seen in FIG. 3, a top perspective of the present invention, each small base of each musical piece has a designated recess in size and cross sectional shape on the base 20 into which it rests, with each recess corresponding in color, size and shape, to the musical instrument or playing piece which it holds. The recesses are coordinated with the color of the small bases and the instruments. There is a green cavity-like square in cross sectional recess 100 for the green, small square shaped base 40*a* of the clarinet 40; a yellow rectangle in cross section cavity-like recess 102 for the yellow, small rectangular base 42*a* for the flute 42; an orange pentagon in cross section cavity-like recess 104 for the orange, small pentagon shaped base 44*a* for the trumpet 44; a peach tear-drop or pie segment in cross section cavity-like recess 106 for the small peach, pie-shaped wedge or base 46*a* of the tuba 46; a red circular in cross section cavity-like recess 108 for the red, circular small base 48*a* for the drum 48; a light purple four leaf clover in cross section cavity-like recess 110 for the small light purple, clover-shaped base 50*a* of the set of cymbals 50; a light blue star in cross section or cavity 112 for the light blue, small star-shaped base 52*a* for the xylophone 52; a dark blue rectangle in cross section cavity 114 for the dark blue, small rectangular base 54*a* of the piano 54; a dark purple hexagon in cross section cavity 116 for the dark purple, small hexagon-shaped base 56*a* for the accordion 56; a hot pink cross or "plus" symbol cavity or recess 118 for the hot pink small "plus shaped base 58*a* of the sitar 58; a white half moon in cross section recess 120 for the white, small base 60*a* of the guitar 60; a forest green diamond in cross section cavity 122 for the small forest green, base 62*a* for the koto 62; and a brown oval in cross section cavity 124 for the brown, small base 64*a* of the violin 64.

Figure 4:
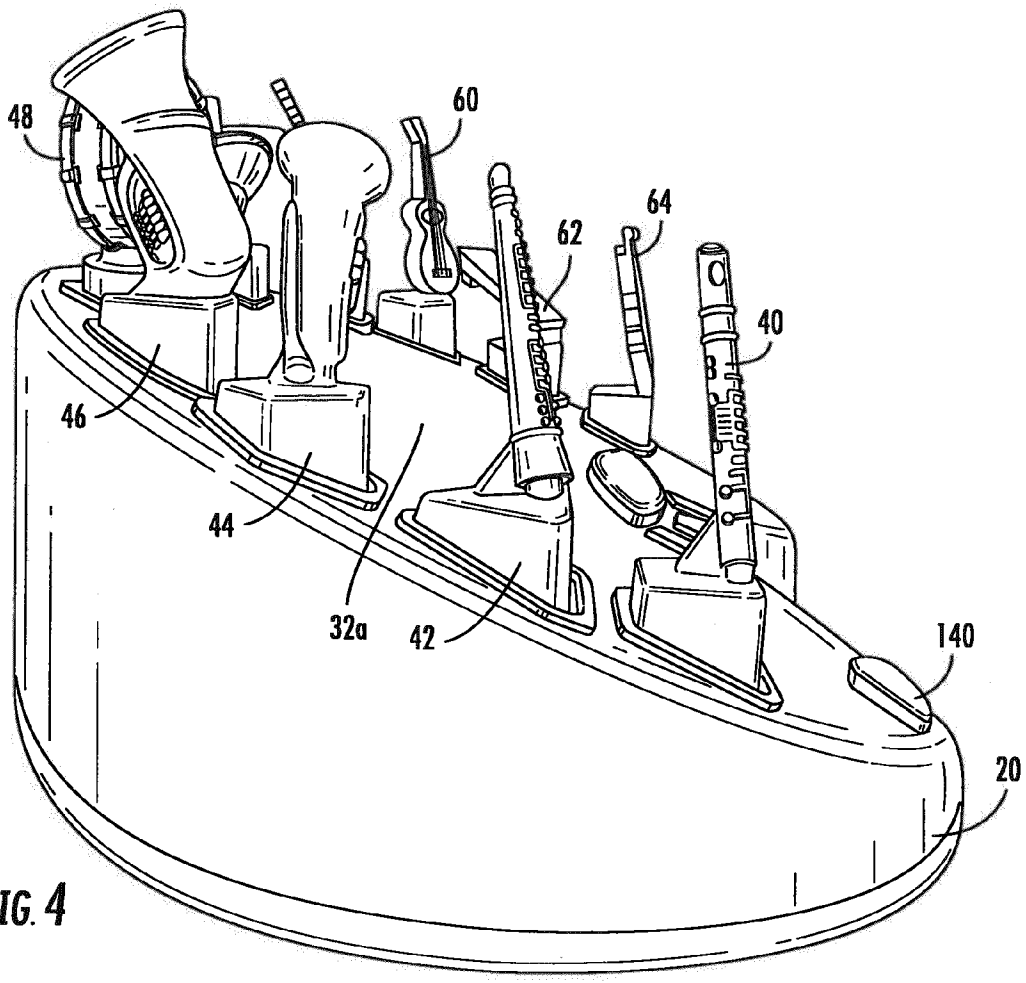
FIG. 4 is a left side elevational view of the present invention shown in FIG. 1.
Figure 5:
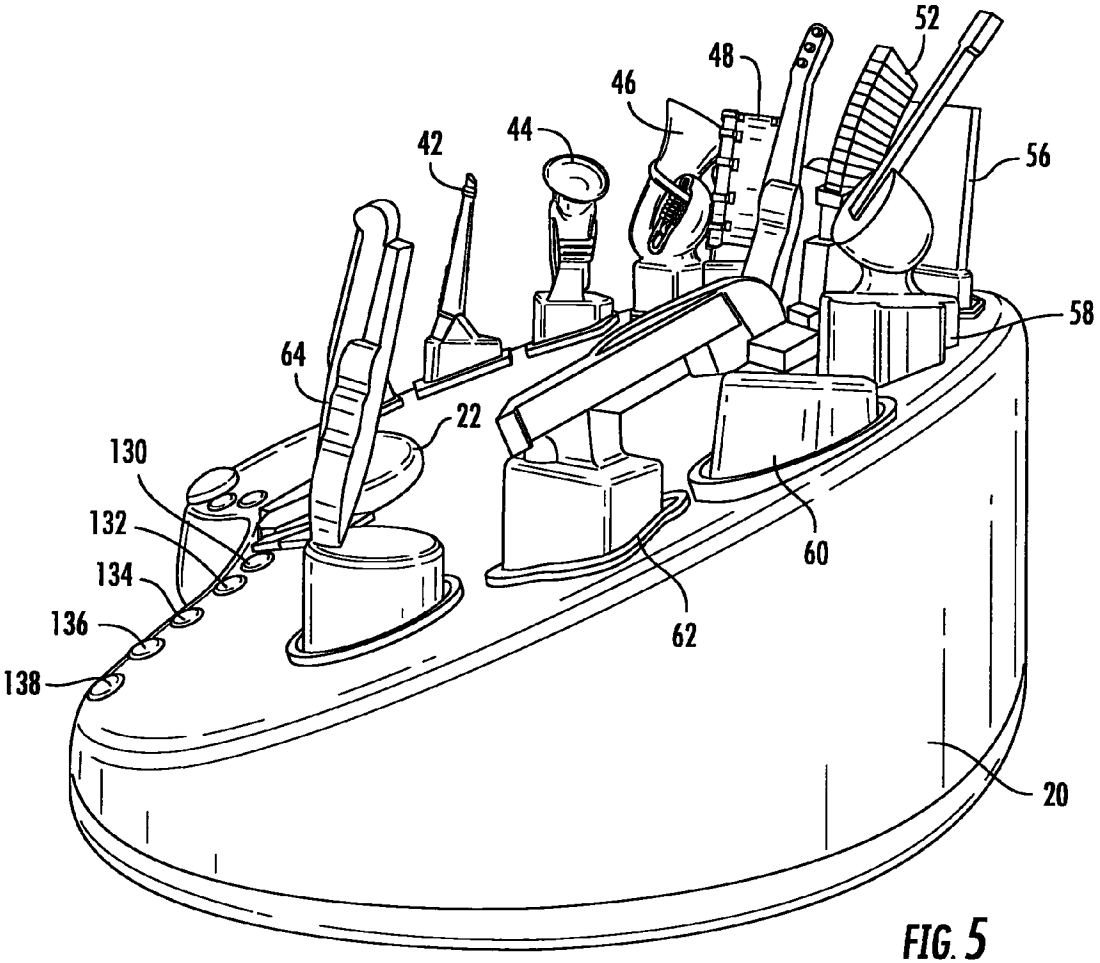
FIG. 5 is a right side elevational view of the present invention shown in FIG. 1.
Figure 6:
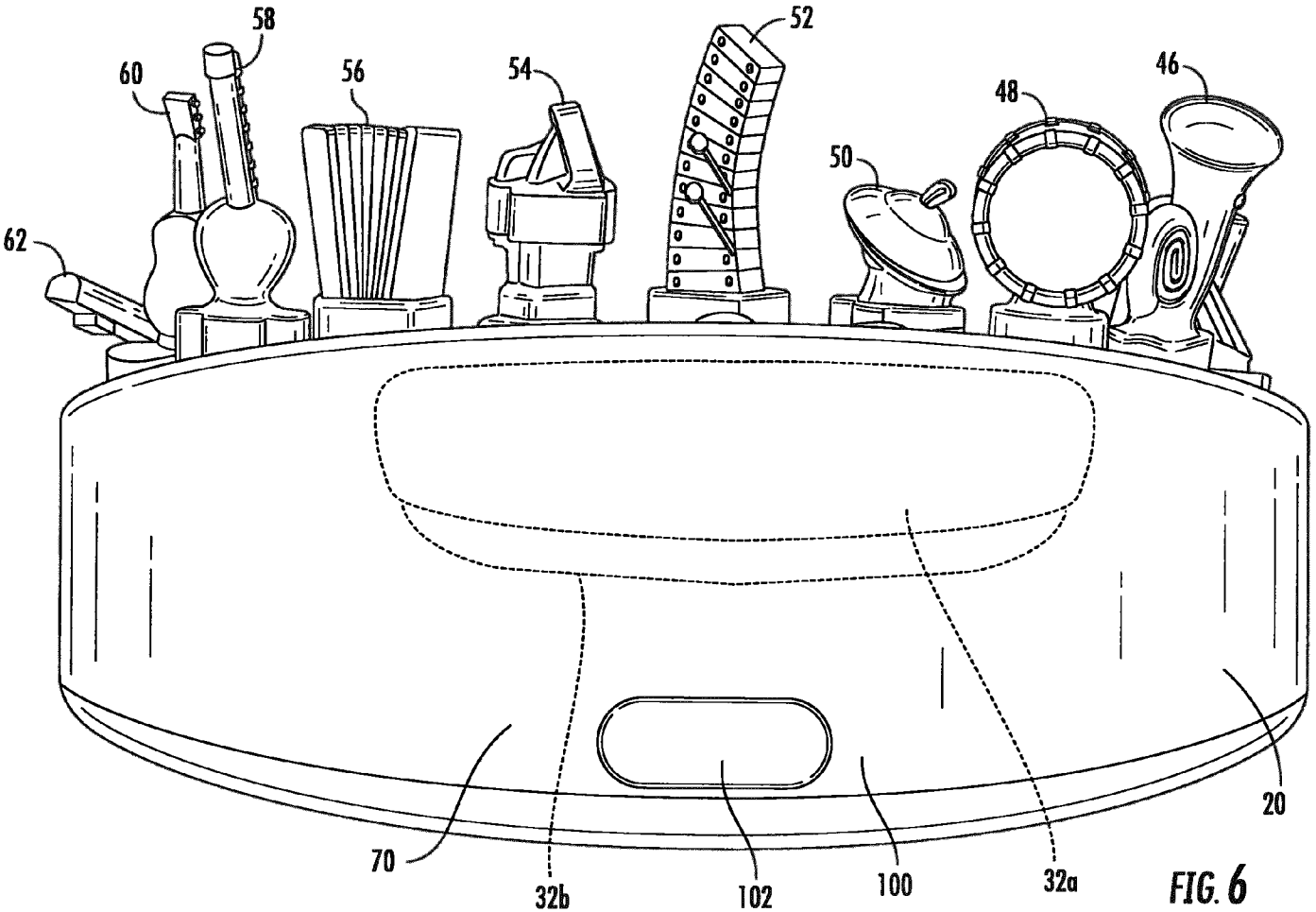
FIG. 6 is a rear elevational view of the present invention.

FIGS. 4 and 5 are left and right side elevational perspectives, respectively, of the present invention in its current commercial embodiment. FIG. 6 is a rear perspective of the present invention. As is shown from this view, in the rear of base 20 has a vertically slidable door 100 which provides selective access to an internal chamber 70 within the rear of the main base, but separated by internal walls from the other internal components of the base. This chamber 70 is large enough to hold all musical pieces 40-64 when the device is being stored or moved by a user. The cover or door 100 to chamber 70 can be lifted (by the finger recess 102) to allow access to the chamber for placement and removal of the pieces into and out of the holding chamber or internal compartment.

Figure 7:
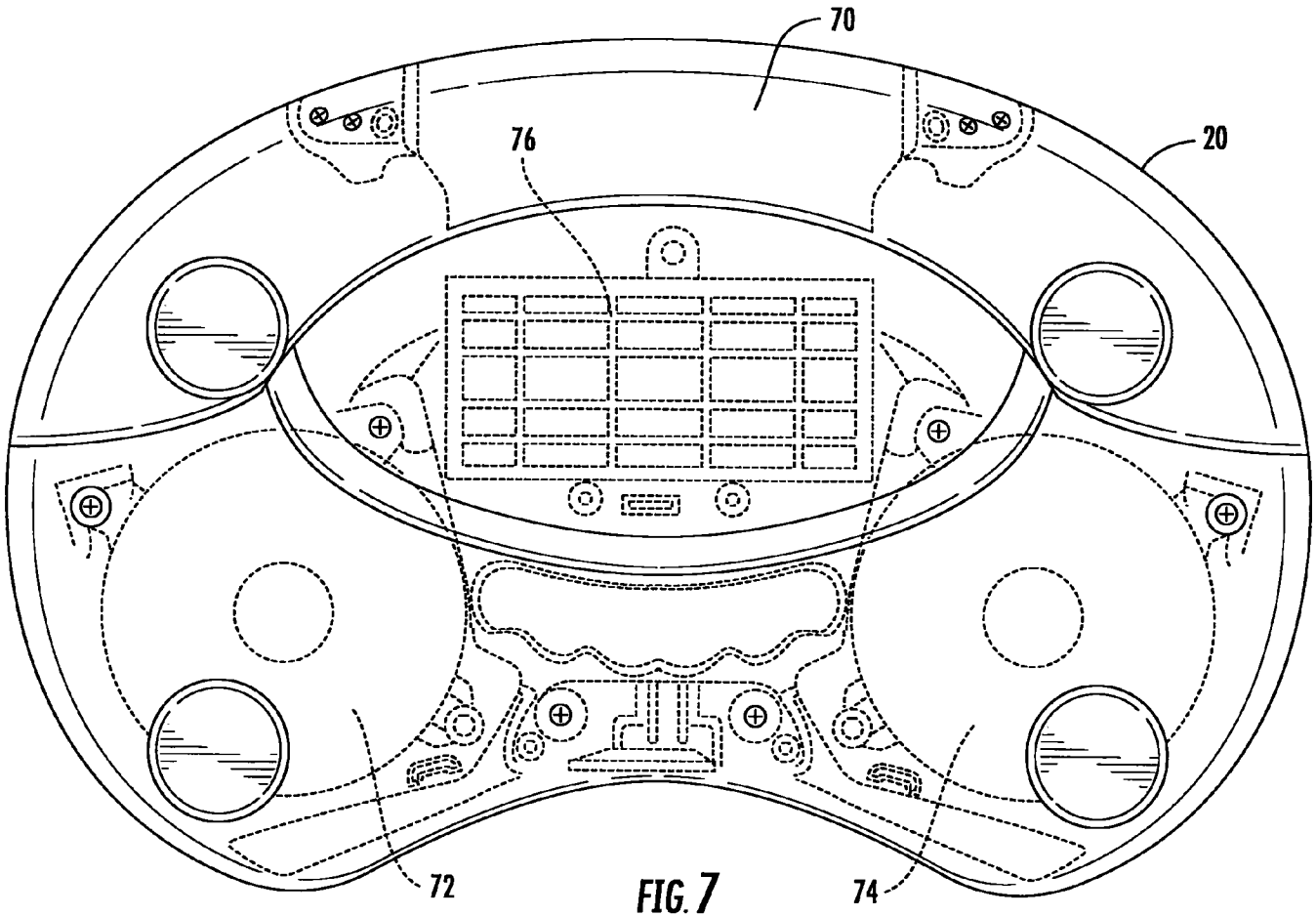
FIG. 7 is a bottom view of the present invention, showing much of the contained inner electronics. For the purposes of the present application and for commercialization, the main base is formed of a clear and transparent plastic so that the inside components can be more easily seen.

FIG. 7 is a bottom view of the present invention. Some of the inner components and electronics of the present invention can be seen. Specifically, battery case 76 is shown, as the present invention is battery-operated. Removable screws can be provided to allow for placement and replacement (and removal) of batteries. Additionally, speakers 72 and 74 are shown, which produce the audible musical notes associated with the musical instruments and playing pieces (when placed in the orchestra pit 32). Preferably, the top surface 21 of the main base is provided with one or more openings near the speakers so that the sound generated thereby is caused to "echo" through the device and up and out through the top surface. The sound is very pleasing.

Figure 8:
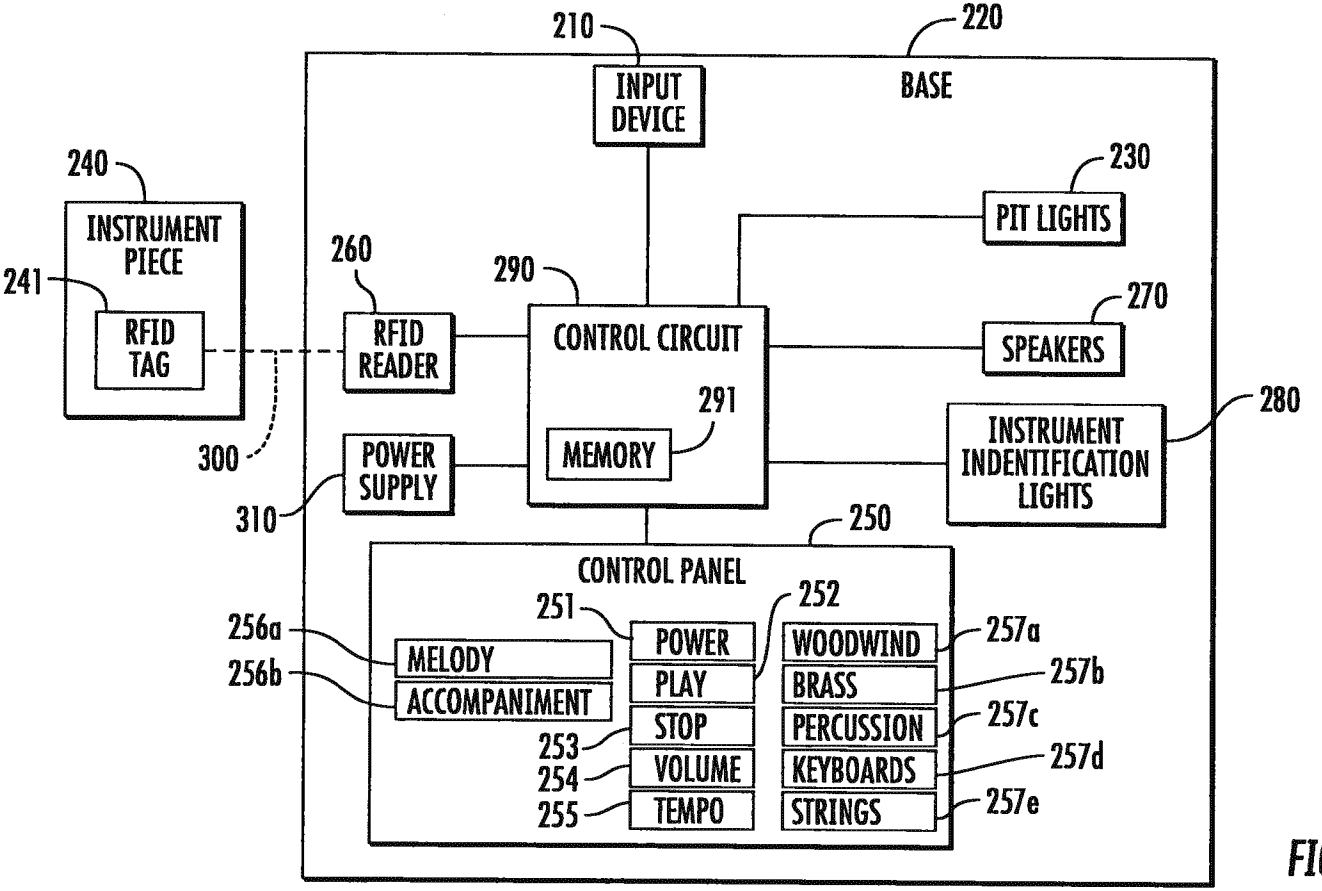
FIG. 8 is a schematic of the electronic circuitry for the invention.

FIG. 8 is a schematic diagram of the electronic circuitry of the preferred embodiment of the present invention. Within the base of the preferred embodiment are base electronics 220, which include a control circuit 290 coupled to control panel 250, one or more orchestral pit lights 230, speakers 270, one or more instrument identification lights 280, at least one RFID reader 260, and power supply 310.

Control circuit 290 includes a memory 291 for storing the songs that may be played on the device, as well as the individual instrument sounds for each of these songs. This is done by dedicating a separate channel for each musical instrument for each of the musical compositions. Control circuit 210 may be coupled to an input device 210, such as a physical connection (including, for example, a USB port and other similar connection) or a wireless connection (including, for example, a Bluetooth or other connection) for allowing a user to add or remove additional musical compositions or songs to the device's memory.

In the preferred embodiment, control panel 250 includes buttons or other similar tactile input devices 251-255 that allow the user to turn the power on and off (251), play or select a musical composition or song (252), stop a song (253), increase or decrease the volume (254), and increase or decrease the tempo (255). This embodiment also includes buttons or other similar tactile input devices for identifying the instrument pieces associated with the melody (256*a*) and the accompaniment (256*b*) to other instruments for each of the compositions. As described above, activating one of these tactile input devices causes the illumination of instrument identification lights 280 associated with the melody or accompaniment, respectively, of the particular song being played. In addition, this embodiment also includes buttons or other similar tactile input devices 257*a*-257*e* for identifying the instrument pieces within categories of woodwinds (257*a*), brass (257*b*), percussion (257*c*), keyboards (257*d*), and strings (257*e*). As described above, activating one of these tactile input devices causes the illumination of instrument identification lights 280 associated with the selected category of instruments.

Power supply 310 may be a battery pack for holding non-rechargeable batteries or may include a rechargeable battery pack or connection to AC power. Instrument pieces include instrument piece electronics 240 which further include RFID tag 241 (one unique such tag per instrument). As described above, when RFID tag 241 is in close proximity to RFID reader (as described above when an instrument piece is placed in the device's orchestra pit area), RFID reader 260 is in radio communication 300 with RFID tag 241. Thus, both RFID tag 241 and RFID reader send and receive radio signals through radio communication path 300. Accordingly, RFID reader acts as an instrument piece identifier. Other electronic devices (such as capacitive or infrared systems) or physical devices (such as mechanical keys or tabs) may also be used as instrument piece identifiers. Other mechanical means and electronic means may be used to identify when and which instruments are within the orchestral pit area.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed is:

1. A music playing device for symphonic compositions, comprising:

at least two unique musical instrument playing pieces, a main base, a musical instrument playing piece identification area;

said device further comprising a sensing and identifier means for sensing when and identifying which of said musical instrument playing pieces are placed proximal to said musical instrument playing piece identification area, said base further comprising an electronic control circuit coupled to said sensing and identifier means, to a power means, to an integrated circuit and memory means having stored therein a set of musical notes for each of said musical instrument playing pieces for each of said symphonic compositions and electrical wiring means connecting the same to at least one speaker, wherein said sensing and identifier means transmits a unique signal to said control circuit identifying each of said musical instrument playing pieces when proximal to said musical instrument playing piece identification area and said control circuit is capable of retrieving from said integrated circuit and memory means, transmitting and audibly generating through said speaker, the set of musical notes associated with said musical instrument playing piece when placed in proximity to said musical instrument playing piece identification area; and wherein said musical instrument playing piece sensing and identifier means is an RFID interrogation reader and receiver, and said musical instrument playing pieces each comprise a unique RFID tag.

2. The music playing device for symphonic compositions of claim 1 wherein said musical instrument piece playing piece depicts a musical instrument.

3. The music playing device for symphonic compositions of claim 2 wherein said depiction is a three dimensional representation of a musical instrument.

4. The music playing device for symphonic compositions of claim 1 wherein said musical instrument playing piece identification area is recessed into said main base and said musical instrument playing pieces are isolated therefrom by individual recesses for each of said musical instrument playing pieces.

5. The music playing device for symphonic compositions of claim 1 wherein said main base further includes one or more controls coupled to said control circuit, said controls allowing a user to control one or more of the following: volume; tempo; selection of symphonic composition; stopping of said audible signals through said speakers and on-off.

6. The music playing device for symphonic compositions of claim 5 wherein said control(s) is(are) a manually depressible button(s).

7. The music playing device for symphonic compositions of claim 1 wherein said main base includes an internal storage area for storing said musical instrument playing pieces in a manner isolated from said control circuit.

8. The music playing device for symphonic compositions as claimed in claim 1 wherein said integrated circuit and memory means is a multi-channel mechanism for storing said set of musical notes associated with each of said musical instrument playing pieces for each of said musical compositions to be played by said music playing device for symphonic compositions.

9. The musical playing device for symphonic compositions of claim 1 wherein said set of musical notes of each of said musical instrument playing pieces are synchronized in time with each other when audibly generated through said speaker.

10. The musical playing device for symphonic compositions of claim 1 wherein said main base further comprises a musical instrument playing piece identification light uniquely associated with each of said musical instrument playing pieces and coupled to said control circuit for illuminating which of said musical instrument playing pieces is proximal to said musical instrument playing piece identification area.

11. The musical playing device for symphonic compositions as claimed in claim 10 wherein said musical instrument playing piece identification light(s) is located in said musical instrument playing piece identification area.

12. The musical playing device for symphonic compositions as claimed in claim 11 wherein said musical instrument playing piece identification area is recessed within said main base.

13. The musical playing device for symphonic compositions as claimed in claim 1 wherein said musical instrument playing piece identification area comprises a recessed pit in said main base having two or more levels.

14. The musical playing device for symphonic compositions of claim 1 further comprising musical instrument playing pieces identification lights, wherein said main base further includes a querying means connected to said lights and said control circuit means for receiving an input signal from a user for requesting identification of a subset of said instrument pieces by musical instrument category, wherein said control circuit is capable of generating a signal to illuminate said musical instrument playing piece identification light corresponding to the musical instrument playing pieces which are within said musical instrument category.

15. The musical playing device for symphonic compositions of claim 1 wherein said musical instrument playing piece identification area is capable of holding only a limited number of all of said musical instrument playing pieces.

16. A music playing device for symphonic compositions, comprising:

at least two unique musical instrument playing pieces, a main base, a musical instrument playing piece identification area;

said device further comprising a sensing and identifier means for sensing when and identifying which of said musical instrument playing pieces are placed proximal to said musical instrument playing piece identification area, said base further comprising an electronic control circuit coupled to said sensing and identifier means, to a power means, to an integrated circuit and memory means having stored therein a set of musical notes for each of said musical instrument playing pieces for each of said symphonic compositions and electrical wiring means connecting the same to at least one speaker, wherein said sensing and identifier means transmits a unique signal to said control circuit identifying each of said musical instrument playing pieces when proximal to said musical instrument playing piece identification area and said control circuit is capable of retrieving from said integrated circuit and memory means, transmitting and audibly generating through said speaker, the set of musical notes associated with said musical instrument playing piece when placed in proximity to said musical instrument playing piece identification area;

wherein said musical instrument playing pieces each comprise a small base portion of a geometric shape in cross section and said main base comprises individual, separated and dimensionally different from one another geometric shaped recesses of corresponding geometric shape to said small base portions for said musical instrument playing pieces for receiving and storing said musical instrument playing pieces.

17. The music playing device for symphonic compositions of claim 16 wherein said musical instrument piece playing piece depicts a musical instrument.

18. The music playing device for symphonic compositions of claim 17 wherein said depiction is a three dimensional representation of a musical instrument.

19. The music playing device for symphonic compositions of claim 16 wherein said musical instrument playing piece identification area is recessed into said main base and said musical instrument playing pieces are isolated therefrom by individual recesses for holding the base of each of said musical instrument playing pieces.

20. The musical playing device for symphonic compositions of claim 16 wherein said musical instrument playing piece identification area is capable of holding only a limited number of all of said musical instrument playing pieces.

21. A musical playing device for symphonic compositions as claimed in claim 20, wherein a plurality of musical instrument playing pieces are provided and said musical instrument playing piece identification area is sized to only hold less than half of said plurality of said musical instrument playing pieces.

22. A music playing device for symphonic compositions, comprising:

at least two unique musical instrument playing pieces, a main base, a musical instrument playing piece identification area;

said device further comprising a sensing and identifier means for sensing when and identifying which of said musical instrument playing pieces are placed proximal to said musical instrument playing piece identification area, said base further comprising an electronic control circuit coupled to said sensing and identifier means, to a power means, to an integrated circuit and memory means having stored therein a set of musical notes for each of said musical instrument playing pieces for each of said symphonic compositions and electrical wiring means connecting the same to at least one speaker, wherein said sensing and identifier means transmits a unique signal to said control circuit identifying each of said musical instrument playing pieces when proximal to said musical instrument playing piece identification area and said control circuit is capable of retrieving from said integrated circuit and memory means, transmitting and audibly generating through said speaker, the set of musical notes associated with said musical instrument playing piece when placed in proximity to said musical instrument playing piece identification area; and wherein said musical instrument playing piece identification area is a continuous recess in the top surface of said main base, so as to allow for two or more adjacent playing pieces to be located thereon and to touch one another.

23. The music playing device for symphonic compositions of claim 22 wherein said musical instrument piece playing piece depicts a musical instrument.

24. The music playing device for symphonic compositions of claim 23 wherein said depiction is a three dimensional representation of a musical instrument.

25. The musical playing device for symphonic compositions of claim 22 wherein said musical instrument playing piece identification area is sized to hold only a limited number of all of said musical instrument playing pieces.

26. A method of operating an orchestral music playing device for a musical symphonic composition, comprising:

providing at least two unique musical instrument playing pieces;

providing a main base, comprising a musical instrument playing piece identification area and a sensing and identifying means for detecting when and which of said musical instrument playing pieces is located proximal to said musical instrument playing piece identification area, said main base further comprising at least one speaker, a power means, and an integrated circuit and memory means for storing individual sets of notes for said musical instrument playing pieces of said musical symphonic composition;

placing at least one of said musical instrument playing pieces in proximity to said musical instrument playing piece identification area, sensing and identifying, by said musical instrument playing piece sensing and identifying means, which of said musical instrument playing pieces are in proximity to said musical instrument playing piece identification area, sending a signal to said integrated circuit and memory means identifying each of said musical instrument playing pieces in proximity to said musical instrument playing piece identification area, and sending and generating for audible transmission through said speaker(s), through said integrated circuit and memory means, a set of musical notes associated with each of said musical instrument playing pieces in proximity to said musical instrument playing piece identification area;

wherein said musical instrument playing piece sensing and identifier means is an RFID reader in said main base and each of said musical instrument playing pieces comprises a unique, identifying RFID tag.

27. The method of claim 26 further including the step of synchronizing said musical notes for each of said musical instrument playing pieces.

28. A music playing device for symphonic compositions, comprising:

a plurality of unique musical instrument playing pieces, a main base, a musical instrument playing piece identification area;

said device further comprising a sensing and identifier means for sensing when and identifying which of said musical instrument playing pieces are placed proximal to said musical instrument playing piece identification area, said base further comprising an electronic control circuit coupled to said sensing and identifier means, to a power means, to an integrated circuit and memory means having stored therein a set of musical notes for each of said musical instrument playing pieces for each of said symphonic compositions and electrical wiring means connecting the same to at least one speaker, wherein said sensing and identifier means transmits a unique signal to said control circuit identifying each of said musical instrument playing pieces when proximal to said musical instrument playing piece identification area and said control circuit is capable of retrieving from said integrated circuit and memory means, transmitting and audibly generating through said speaker, the set of musical notes associated with said musical instrument playing piece when placed in proximity to said musical instrument playing piece identification area;

wherein said musical instrument playing piece identification area comprises a recessed pit in said main base having two or more levels; and wherein said musical instrument playing piece identification area simultaneously holds several and up to 6 of said plurality of said musical instrument playing pieces.

29. The music playing device for symphonic compositions of claim 28 wherein said musical instrument piece playing piece depicts a musical instrument.

30. The music playing device for symphonic compositions of claim 29 wherein said depiction is a three dimensional representation of a musical instrument.

31. The music playing device for symphonic compositions of claim 28 wherein said musical instrument playing piece identification area is recessed into said main base and said musical instrument playing pieces can be isolated therefrom by individual recesses for holding the base of each of said musical instrument playing pieces when not located in said recessed pit.

* * * * *